US008931409B2

(12) United States Patent
Rogge

(10) Patent No.: US 8,931,409 B2
(45) Date of Patent: Jan. 13, 2015

(54) PRINTING PRESS WITH MULTIPLE INKING UNITS

(75) Inventor: Guenter Rogge, Lienen (DE)

(73) Assignee: Windmoeller & Hoelscher KG, Lengerich (DE)

( * ) Notice: Subject to any disclaimer, the term of this patent is extended or adjusted under 35 U.S.C. 154(b) by 274 days.

(21) Appl. No.: 12/736,979

(22) PCT Filed: May 27, 2009

(86) PCT No.: PCT/EP2009/003774

§ 371 (c)(1),
(2), (4) Date: Jan. 11, 2011

(87) PCT Pub. No.: WO2009/144016

PCT Pub. Date: Dec. 3, 2009

(65) Prior Publication Data

US 2011/0120330 A1 May 26, 2011

(30) Foreign Application Priority Data

May 29, 2008 (DE) ..... 10 2008 025 996

(51) Int. Cl.

| | |
|---|---|
| ***B41F 13/20*** | (2006.01) |
| ***B41K 1/22*** | (2006.01) |
| ***B41F 13/44*** | (2006.01) |
| ***B41F 13/00*** | (2006.01) |
| ***B41F 5/24*** | (2006.01) |
| ***B41F 27/10*** | (2006.01) |

(52) U.S. Cl.

CPC ..... *B41F 13/0016* (2013.01); *B41F 5/24* (2013.01); *B41F 27/105* (2013.01); *B41P 2213/804* (2013.01)

USPC ..... 101/479; 101/483

(58) Field of Classification Search

CPC ..... B41F 13/20; B41F 13/44; B41F 27/12; B41F 27/105; B41P 2213/804; B41P 2217/15

USPC ..... 101/349.1, 479, 480, 483, 477

See application file for complete search history.

(56) References Cited

U.S. PATENT DOCUMENTS 4,586,434 A * 5/1986 Tokuno et al. ..... 101/178
5,010,813 A * 4/1991 Buffo ..... 101/178

(Continued)

FOREIGN PATENT DOCUMENTS

DE 9208023 11/1992
DE 10 2005 039 782 A1 3/2007

(Continued)

*Primary Examiner* — Ren Yan
*Assistant Examiner* — Leo T Hinze
(74) *Attorney, Agent, or Firm* — Jacobson Holman Hershkovitz, PLLC

(57) ABSTRACT

A printing press includes a plurality of inking systems, which cooperate with at least one impression cylinder, each inking system including a print roller and at least one additional ink-transfer roller, each of which includes a roller body, at the front sides of which a first and a second end shaft journal is disposed. The printing press includes at least one roller-bearing device, in which the print rollers and the ink-transfer rollers can be mounted in roller-bearing positions, and a transfer element, via which at least the print rollers or the ink-transfer rollers can be transported between the roller-bearing positions and the inking systems. At least one roller-bearing position, in which one of the rollers can be set up for a subsequent print job, is provided in the roller-bearing device.

14 Claims, 6 Drawing Sheets

(56) References Cited

U.S. PATENT DOCUMENTS

| | | | | |
|---|---|---|---|---|
| 5,385,093 | A | 1/1995 | Rogge et al. | |
| 5,669,302 | A * | 9/1997 | Rogge et al. | 101/216 |
| 5,802,975 | A * | 9/1998 | Prem et al. | 101/375 |
| 5,906,162 | A | 5/1999 | Kolbe et al. | |
| 6,038,972 | A | 3/2000 | Delwiche et al. | |
| 6,543,357 | B2 | 4/2003 | Schroeder | |
| 8,141,239 | B2 * | 3/2012 | Rogge | 29/809 |

FOREIGN PATENT DOCUMENTS

| | | | |
|---|---|---|---|
| EP | 0 741 009 | | 5/1999 |
| EP | 1 016 522 | | 7/2000 |
| EP | 1 151 862 | A2 | 11/2001 |
| EP | 1 776 231 | | 3/2008 |
| ES | 2 264 323 | | 12/2006 |
| GB | 2 158 774 | A | 11/1985 |
| WO | WO 2008043714 | A1 * | 4/2008 |

* cited by examiner c-c
33
53
50
52
40
42
44
a
a b-b
33
42
39
43
44
40
41
c
c a-a
33
49
45
48
46
47
40
41
44
43
b
b

PRINTING PRESS WITH MULTIPLE INKING UNITS

CROSS-REFERENCE TO RELATED APPLICATIONS

This is a national stage of PCT/EP09/003774 filed May 27, 2009 and published in German, which has a priority of German no. 10 2008 025 996.9 filed May 29, 2008, hereby incorporated by reference.

BACKGROUND OF THE INVENTION

1. Field of Invention

The invention relates to a printing press comprising a plurality of inking systems, which cooperate with at least one impression cylinder.

2. Description of the Prior Art

Such printing presses are primarily known for printing flexible materials. The at least one impression cylinder is often in the form of a single central impression cylinder with which the inking systems cooperate. In place of a single impression cylinder, it is also possible to provide a plurality of impression cylinders that are then arranged such that the web of printing substrate is guided only from one side. For example, the path of the web can closely imitate a circular path.

A printing press comprising a central impression cylinder is usually used for printing plastic webs for packaging purposes. But also webs of paper or paperboard that can be used subsequently for the production of cardboard packaging are often printed by means of these printing presses.

An inking system, which cooperates with an impression cylinder or the impression cylinder, comprises a print roller carrying the actual print image and at least one ink-transfer roller. An inking system of a flexographic printing press usually used for the package printing mentioned above comprises a print roller and a so-called anilox roller in the form of an ink-transfer roller that draws printing ink from an ink reservoir and applies the same to the print roller. The print roller transfers the ink that is applied to only the raised printing plates of the print roller that represent the print image onto the printing substrate. The ink reservoir is mostly an ink chamber blade that together with the anilox roller delimits a closed space.

Primarily in the field of package printing, it is frequently necessary to change not only the print motif but also the print format. Central cylinder flexographic printing presses are therefore constructed such that they exhibit a wide range of variety in formats. For changing the print format, it is usually necessary to change the diameter of at least the print roller.

Two concepts that aim at facilitating these change processes have taken hold in recent years. One concept is formed by the so-called sleeve machines, in which the print and anilox rollers comprise a cylinder mandrel and one or more sleeves that are disposed concentrically thereto. For adapting the format and/or motif, the cylinder mandrels within the inking system can now be exposed at one end thereof so that the sleeves can be pulled off in the axial direction from this end of the cylinder mandrel and new sleeves can be slid onto the rollers. Since the sleeves have relatively low dead weight, they can often be changed manually. The outer sleeve carries the printing plate. Intermediate or adapter sleeves are used for adapting the diameter of the print roller over wide regions. Such a printing press is disclosed in the patent application EP 0 741 009 B1.

A second concept consists in lifting print rollers that are mounted by means of their journals in bearing blocks of the inking systems in their entirety out of the printing press and replacing them with print rollers having different diameters. The print rollers lifted out of the printing press are then usually removed from the printing press by means of suitable transporting carriages and put in storage or set up for the next print job in that the old printing plates are removed and new printing plates are glued onto the outer circumference of the roller. Here, too, sleeves carrying the printing plates can also be fitted on the rollers. Printing presses constructed according to this concept usually ensure improved print quality as compared to printing presses based on the first concept since, in most cases, there is no requirement of adapter sleeves for adapting the diameters of the rollers. The process of adapting the diameters of the rollers is carried out by selecting a base roller having the corresponding diameter. Print rollers comprising adapter sleeves are often susceptible to vibrations. Printing presses constructed according to the second concept are therefore recommended for large printing widths. These printing presses are also referred to as web fed presses.

In the recent past, there has been a strong tendency among orders for operators of printing presses to have smaller batch sizes. It is therefore increasingly important to keep short the unproductive period of time taken to change the motif and format. Printing presses operating according to the first concept are clearly advantageous in this respect particularly when the sleeves can be directly advanced to the inking system in question by means of auxiliary devices such as lifting platforms.

Also in the case of printing presses that ensure high print quality, there is an ever increasing desire to achieve short change times. EP 1016 522 A 1 therefore suggests roller-bearing devices, in the roller-bearing positions of which the print rollers can be mounted so as to be fully prepared for the subsequent print job. The rollers that have already been set up for the follow-up job in a corresponding section of the print operation have to be supplied by a roller-transporting carriage to the roller-bearing device. A robot then places the prepared rollers in the roller-bearing device. After the completion of the current print job, the old rollers and also the doctor blade chambers are first lifted out of each inking system by means of the robot, deposited in the roller-bearing device, and new rollers and a new doctor blade chamber are removed from the roller-bearing device and conveyed to the inking system. When the process of changing the rollers is complete, the old rollers can be loaded onto the transporting carriage and removed, and then new rollers are again supplied by the transporting carriages to the roller-bearing device.

Yet, the process of repeatedly loading up the roller-bearing device takes up too much time particularly since printing presses these days can often process more than 600 meters of printing substrate per minute. The print rollers are often not available for the subsequent job when the current print job is complete.

SUMMARY OF THE INVENTION

It is therefore the object of the present invention to suggest a web fed press, in which the time taken to change the print motif and the print format can be reduced further.

This object is achieved by the printing press described herein, which includes a plurality of inking systems, which cooperate with at least one impression cylinder, each inking system including a print roller and at least one additional ink-transfer roller, each of which has a roller body, at the front sides of which a first and a second end shaft journal are disposed. The printing press includes at least one roller-bearing device, in which print rollers and ink-transfer rollers can be mounted outside the inking systems in roller-bearing positions, and transfer means, via which at least the print rollers or the ink-transfer rollers can be transported substantially in their radial directions between the roller-bearing positions and the inking systems. At least one roller-bearing position, in which one of the rollers can be set up for a subsequent print job, is provided in the roller-bearing device.

Accordingly, at least one roller-bearing position, in which one of said rollers can be set up for a subsequent print job, is provided in the roller-bearing device. The major advantage of the invention is that rollers no longer have to be removed from the printing press or the roller-bearing device assigned thereto by means of carriages or similar auxiliary devices in order to prepare them for the next print job. This advantage is manifested in that the rollers are transported only in radial direction of the rollers both during their removal from the inking systems, during transport and during the process of setting them up for the next print job. There occurs no significant movement of the rollers in the axial direction. In this context, "insignificant movements" refer to axial movements having smaller path lengths, for example for purposes of adjustment. These path lengths can be in the range of a few ten millimeters at most. The roller transported can thus be the print roller that is provided, for example, with a printing plate. In the field of flexographic printing, these printing plates are referred to as plates. These printing plates can be directly applied, for example, glued to the roller body. However, a printing sleeve can also be slid on the cylinder body in the aforementioned roller-bearing position, and the sleeve or the outer sleeve then carries the printing plate. Also the ink-transfer roller, more particularly the anilox rollers used in flexographic printing, can be prepared for the follow-up job in that, for example, the anilox-roller sleeve carrying the functional elements of the anilox roller is replaced.

Due to the rapid preparation of one or more rollers for the follow-up job, these rollers are mostly available even before the completion of the current job and even when the current job involves the printing of only relatively few lineal meters of the substrate to be printed. All in all, the unproductive set-up times are greatly reduced by the printing press of the invention.

The invention is not limited to printing presses operating according to the principle of flexographic printing, but can be used in this field, to advantage. This applies to central cylinder flexographic printing presses, in particular.

In a particularly advantageous embodiment of the invention, provision is made for the roller-bearing device to comprise holding means in the at least one roller-bearing position by means of which holding means the at least one roller can be held at least temporarily on its first or second shaft journal. The holding means are formed such that they can hold the roller at one end thereof. The roller body and the other end are thus exposed so that a print-roller sleeve and/or the adapter sleeve or the sleeve of an ink-transfer roller can be pulled off over this exposed end in the axial direction and a new sleeve can be slid on in the reverse direction. The subsequent print job can thus be prepared by means of the sleeves that then only have to be slid on the roller body when the previous sleeve has been removed. Since the sleeves can thus be changed in the roller-bearing device, the set-up procedure is again accelerated.

In a further embodiment of the invention, the roller-bearing device comprises holding means at four roller-bearing positions so that the actual sleeve change can be carried out at one position while the other positions serve as deposit position and/or waiting positions.

It is advantageous if a roller-bearing position comprises at least a first and a second support means, on each of which a journal of the roller can be placed.

In a further embodiment of the invention, provision is made for the roller-bearing position to comprise at least a first support means, on which the first journal of the roller can be placed and which can be removed from the journal when the roller is held by means of the second journal. This embodiment thus relates to a simple process in order to expose the first journal so that the sleeve can then be changed by way of the same. When the second journal is held securely by holding means, the first support means can then be removed from the first journal. This can be carried out advantageously in the radial direction.

In a further advantageous embodiment of the invention, the support means that can be removed from the first journal comprises a lever arm which is mounted on the roller-bearing device so as to be able to pivot. The lever arm can be articulated, for example, to a support stand of the roller-bearing device or to an add-on part of the support stand. The lever arm can now be pivoted by means of a suitable adjusting device. It is important for the adjusting device to be able to apply sufficient holding force if the roller is not held entirely by means of its second journal or its first journal.

Furthermore, it is advantageous to provide two levers, the first ends of which are connected to each other by means of a swivel joint. The respective other ends of the levers are articulated as follows: The first lever is connected to the lever arm so as to be able to rotate, and the second lever is connected to the roller-bearing device so as to be able to rotate. If an adjusting device, which advantageously is a pressurizing-medium cylinder, now acts on the swivel joint by means of which the two levers are connected to each other, the lever arm can be pivoted as a result of the displacement. The movement of the levers is advantageously limited: If the aforementioned fulcrum moves beyond the point, at which both levers are located parallel to each other, the further movement of the levers is limited by a suitable path delimiter so that the levers do not "break off" and the roller does not fall down when the lever arm is stressed.

Furthermore, it is advantageous if a force-transmitting element, which is located at a distance from the second support means in the axial direction of the journal, acts on the journal that bears on the second support means. For this purpose, it is preferable if this force-transmitting element acts on the journal from the top and if the force-transmitting element acts on the journal on the side oriented away from the roller body.

In a further advantageous embodiment of the invention, provision is made for the roller-bearing device to comprise a larger number of roller-bearing positions than the number resulting from the sum of the maximum number of rollers in the printing press and the number of rollers that can be inserted into two inking systems. In printing presses of this type known in the prior art, the roller-bearing device can receive a complete set of rollers that have already been prepared. Furthermore, four roller positions are free so that rollers from two inking systems that are each equipped with two rollers can be deposited simultaneously in the bearing device. In the case of a printing press comprising eight inking systems, the roller-bearing device thus comprises 12 roller positions, eight of which are occupied by rollers that have been set up preliminarily for the follow-up job. However, a larger number of roller-bearing positions are provided according to the invention so that a plurality of rollers can be set up for a plurality of subsequent jobs. The provision of additional roller-bearing positions is particularly advantageous if different roller diameters resulting in different printing lengths must be used for different jobs, as is common in package printing. Depending on the printing length required, it is then possible to set up the corresponding roller.

It is very advantageous if a plurality of sets of print rollers is mountable in the roller-bearing device. The term "set" denotes the maximum number of print or ink-transfer rollers that can be inserted into the printing press. In the case of an eight-ink printing system therefore, this number is eight print rollers. Ina special exemplary embodiment, three sets of print rollers and one set of anilox rollers can be mounted in the roller-bearing device. In view of the fact that apart from the three sets of print rollers, there is one more set of print rollers located in the printing press itself, it is possible to realize numerous printing lengths that are desirable especially in the field of package printing by means of all these print rollers. This advantage, which exists even if there are only four print rollers of variable diameters, can be explained in that printing sleeves can have different outer diameters even if the inner diameter is the same, and the difference between the inner and the outer diameters should not exceed a defined value for reasons of stability. This clearly shows that it is often not necessary to remove any cylinders from the printing press or the roller-bearing device of the invention or supply any cylinders to the same. This feature also assists in accelerating the flow of work in a printing shop.

BRIEF DESCRIPTION OF THE DRAWINGS

Additional exemplary embodiments of the invention are revealed in the following description and the claims. In the individual figures:

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figures 1, 2:
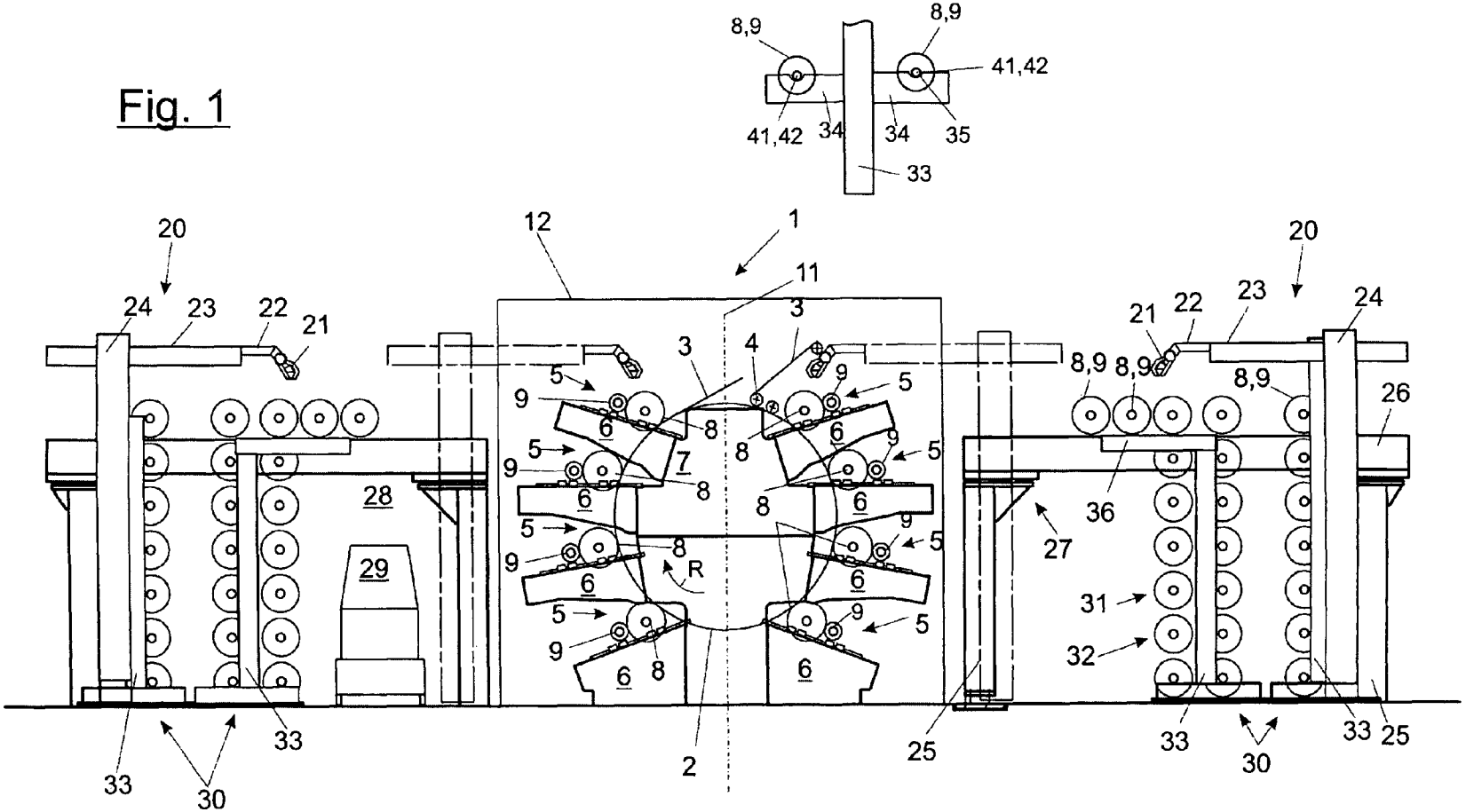
FIG. 1 is a side view of a printing press of the invention.
FIG. 2 shows a section marked in FIG. 1.

FIG. 1 shows a printing press 1 in the form of a central cylinder flexographic printing press in the exemplary embodiment illustrated. It therefore comprises an impression cylinder 2, on which the printing substrate 3 is guided. The direction of rotation of the impression cylinder is denoted by the arrow R. The printing substrate 3 is guided by a pressure roller 4 so that the printing substrate 3 bears completely on the impression cylinder 2 even before reaching the first print roller.

A plurality of inking systems 5, namely eight in the exemplary embodiment shown, is disposed around the impression cylinder 2. Each inking system 5 comprises a bracket 6 extending away from a central frame 7 of the printing press. Each bracket supports the cylinders required for printing an ink. The print rollers 8 can be set against the impression cylinder 2. Anilox rollers 9 that can accordingly be set against the print rollers 8 are provided for applying printing ink to the print rollers 8. The anilox rollers 9 are provided with the printing ink desired in each case from the doctor blade chamber 10 (not shown in FIG. 1). Since particularly the print rollers 8, optionally also the anilox rollers 9, are intended to be replaced with rollers having varying diameters or rollers that differ in terms of their properties (for example, the delivery volume in case of anilox rollers), the aforementioned rollers 8, 9 are mounted in bearing blocks that can be displaced by means of suitable displacing devices relative to the impression cylinder. These displacing devices can comprise guide rails that are mounted on or attached to the bracket and that extend away from the impression cylinder. The displacing devices further comprise drives for displacing the bearing blocks along the guide rails, these drives usually comprising a spindle-spindle nut combination that is well-known per se.

Each of the aforementioned rollers 8, 9 is provided with a drive torque by components that supply torque. These components are often gears each of which engages with a gear mounted on the roller. These gears can be driven by a central drive. For the past few years, printing presses are also known that comprise independent drives for each roller 8, 9 and these drives drive the respective roller by means of gears. In a very advantageous embodiment of a printing press of the invention, the rollers are provided by a drive with the torque required for rotation, but without the use of gears. The axis of rotation of the roller in question and the shaft of the drive are then substantially aligned.

The printing press is surrounded by a housing 12. This housing comprises lateral doors, for example, sliding doors that can be actuated in order to obtain access to the inking systems in the radial direction of the impression cylinder 2. When the doors are open, rollers can be removed from the inking systems or supplied thereto.

For replacing the rollers, the bearings of the bearing blocks, in which the rollers are mounted, are configured such that a removal of the rollers is possible. It is advantageous if the bearings remain on the journals of the rollers and components of the bearing block are swung down so that the rollers can be removed upwardly. Furthermore, the roller must be disconnected from the drive train beforehand. For this purpose, the front sides of the shaft journals preferably comprise coupling elements that are positively locked with corresponding counter pieces. The counter pieces can be displaced by means of actuators in the axial direction of the roller 8, 9 in order to produce or override the positive lock. Any one of these counter pieces is connected to the drive of the roller so that torque can thus travel from the drive to the roller.

For the further explanation of the process of changing the rollers, the printing press is divided theoretically into two halves by an imaginary center line 11 so that half the inking systems 5 are located on each side of this center line. Each half of inking systems is operated by a crane 20 in the exemplary embodiment shown. The crane 20 is able to remove both print rollers 8 and anilox rollers 9 and all rollers involved in the printing process from the printing press and supply them to the same. The crane 20 comprises grippers 21 for taking hold of the rollers 8, 9 and these grippers are able to extend around the journals of the roller. A gripper 21 is thus assigned to each end of the roller.

Each gripper 21 is disposed at the end of a delivery system 22, the delivery system being traversable along a carrier beam 23. The delivery system and the carrier beam are advantageously disposed so as to extend horizontally. It is possible with this arrangement to insert the gripper 21 into the printing press between two brackets 6 and to take hold of a roller 8 or 9 disposed here. In order to reach the various inking systems disposed on top of each other, the carrier beam 23 is disposed on a vertical support 24 so as to be vertically slidable. In order to further increase the traversing options, the vertical support 24 is also slidable, preferably in the horizontal direction. For this purpose, the vertical support 24 is accordingly disposed in or on a supporting frame 27. The supporting frame 27 comprises two columns 25 that are connected to each other by means of a carrier 26. The vertical support 24 advantageously travels on rails that are attached to or mounted on the carrier 26. Summing up, it can be said that the crane includes a total of three traversing options, two of which preferably move the grippers 21 in the horizontal direction and one of which moves the grippers in the vertical direction. If both traversing options for moving the grippers in the horizontal direction are used at the same time and at the same speed, then the gripper 21 travels at twice the speed as that achieved by means of only one traversing option. It is possible in this way to provide all inking systems with rollers and, in doing so, to leave the actual supporting frame 27 entirely outside of the printing press or the housing. It must be emphasized at this point that the directions of movement of the crane are always located parallel to a plane extending perpendicularly to the axes of the rollers. In other words, the crane is not able to move the rollers in the axial direction. An independent drive, for example, an electric motor, is provided for each of the three traversing options mentioned above.

The rollers 8, 9 that have been lifted out of the inking systems by the crane 20 can be deposited in the roller bearing 30. The roller bearing 30 has numerous roller positions 31, in each of which a roller 8, 9 can be deposited. The crane 20 with its possible traverse paths can not only transport a roller 8, 9 between an inking system and a roller position 31, but also between two roller positions 31 so that the rollers can be arranged in the roller bearings in such a way during the printing operation that the set-up process for the subsequent print job can be carried out as effectively as possible, that is, by means of the shortest possible traverse paths for the crane 20.

In order to be able to supply print rollers or ink-transfer rollers to the printing press 1 of the invention, when necessary, a clearance 28, in which a roller-transporting carriage 29 can be introduced and positioned, is provided between the actual printing press and the roller bearing 30. The crane 20 can naturally take hold of the rollers supplied by means of the carriage and deposit them in the roller bearing 30 and/or in the inking systems. The rollers to be removed can then be placed on the roller-transporting carriage 29.

At least one of the roller positions 31 is in the form of a change position 32, in which a roller 8, 9 can be held at one end by devices described further below so that a sleeve that has been slid on the print or anilox roller can be pulled off in the axial direction from the end that is not held by the devices. All in all, anilox rollers or print rollers can be mounted at arbitrary roller positions 31.

The roller positions 31 are disposed on stands 33 of the roller bearing 30. For holding the rollers in the roller positions 31, cantilever arms 34 are attached to the stands 33 so as to be located at a distance from each other in the vertical direction. These cantilever arms 34 comprise recesses 35 on their outer sides and these recesses receive the journals of the rollers in order to prevent the rollers from rolling away (See FIG. 2).

Carriers 36 that are substantially horizontal and that comprise additional roller positions are disposed on certain stands 33. These horizontal carriers 36 span the clearance 28, at least partly, into which a roller-transporting carriage 29 can be introduced. This measure also assists in keeping the times required for equipping the inking systems 5 with new rollers as short as possible since the traverse paths from here are particularly short.

Roller bearings 30 each comprising 23 roller positions 31 are provided for each half of the printing press 1. These roller positions 23 are well-suited to receive four sets of print rollers, each of which comprises four rollers, and one set of anilox rollers comprising four rollers. Two additional positions are formed as change positions and/or they serve for receiving one or more rollers that have been removed from an inking system. If the rollers located in the printing press are also added, the resulting conclusion is that there are five sets of print rollers and two sets of anilox rollers located in the printing press. If the printing press is operated exclusively by means of rollers having printing sleeves slid on, then there is usually no requirement of supplying any rollers by means of the roller-transporting carriage 29. Five print rollers are then available for each inking system, and these five print rollers together with printing sleeves of varying outer diameters cover almost the entire range of size lengths provided by the printing press without necessitating so-called adapter sleeves, for example.

The roller bearing 30 and the crane 20 are advantageously separated from the surroundings by means of walls. The clearance 28 can be made accessible from the outside by means of doors, preferably sliding doors, if, for example, the operating personnel would like to set up rollers for a follow-up job.

Provision is advantageously made in the printing press for disabling the housing doors from being opened when the doors of the aforementioned walls are open. Vice versa, the doors of the aforementioned walls cannot be opened when the housing doors are open for the purpose of carrying out a roller change by means of the crane. Provision is made to stop the crane if it still becomes necessary to open all doors. All these functions are monitored and controlled by a control device.

Figures 3A, 3B, 3C:
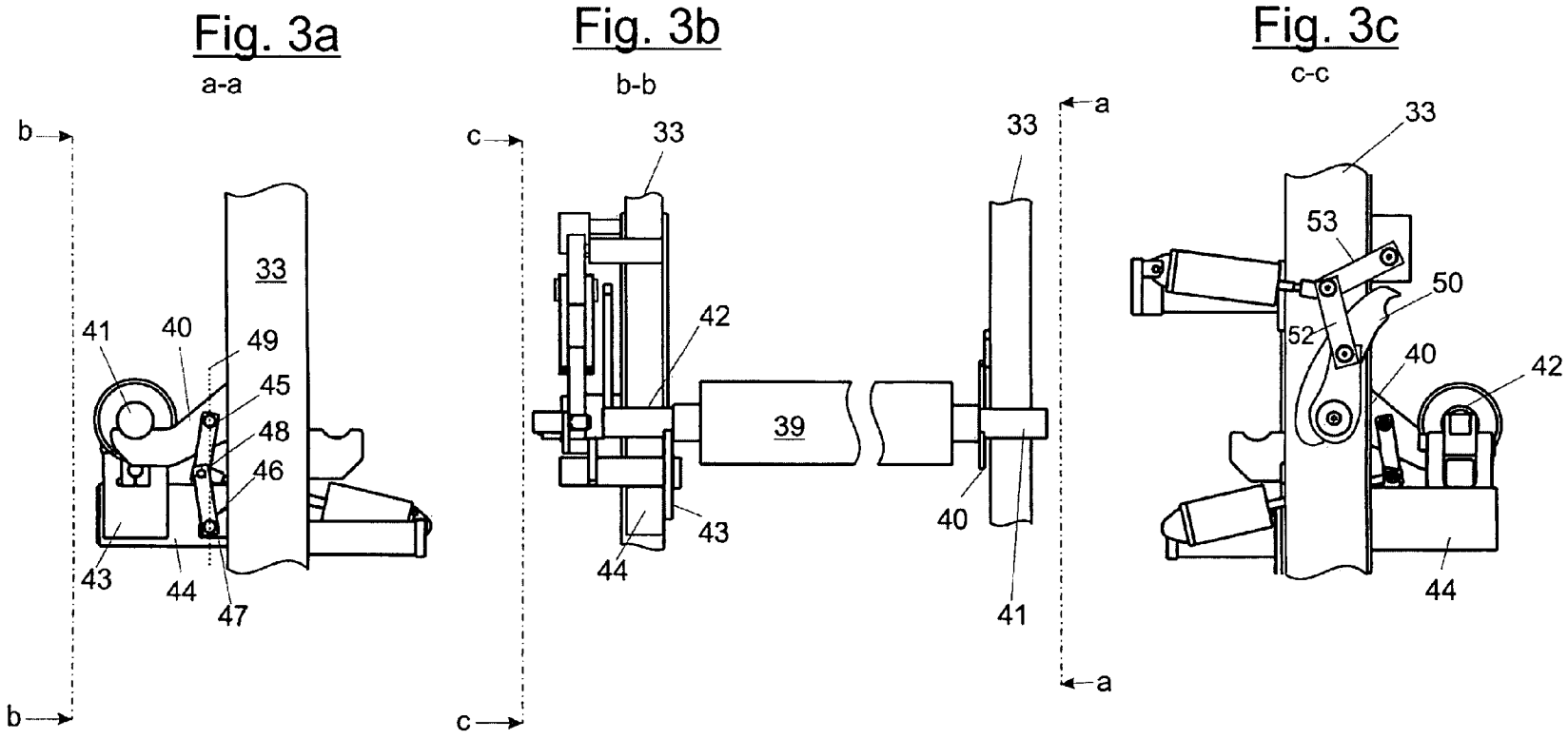
FIGS. 3*a, b, c* are detailed views of a section shown in FIG. 1 comprising a change position, FIGS. 4*a, b, c* are similar to FIGS. 3*a, b, c*, but they also show the second lever arm placed against the second end of the roller, FIGS. 5*a, b, c* are similar to FIGS. 4*a, b, c*, but they also show the first lever arm in its pivoted state, FIGS. 6*a, b, c* are similar to FIGS. 5*a, b, c*, but they also show the pressurizing-medium supply device in its connected state, FIGS. 7*a, b, c* are similar to FIGS. 6*a, b, c*, but they also show the slide in its extended state.

The following figures show the technical elements provided on a printing press of the invention in order to hold a print roller or an ink-transfer roller 8, 9 at one end thereof and to expose the second end. FIGS. 3*a*, 3*b*, 3*c* are different views of a section of the stand 33, in which a change position 32 is disposed. In this section, a lever arm 40 is disposed, on which the first journal 41 of the print or the anilox roller bears (See FIG. 3*a*). The roller 8, 9 bears by means of its second journal 42 on a stationary support 43 attached to a carrier support 44 (See FIG. 3*c*). In this position, the roller 8, 9 can be removed from this bearing position by means of the crane.

FIG. 3*a* shows that the lever arm 40 is held by a first lever 45 and a second lever 46. The levers 45, 46 are articulated to each other. The ends of the lever that are oriented away from this flexible joint 48 are articulated as follows: The lever 45 is articulated to the lever arm 40, whereas the lever 46 is mounted on the stand 33 or an extension 47 attached thereto. The flexible joint 48 is located to the left of the dashed line 49 that joins together the linkage points of the levers 45 and 46. The further rotation of the levers 45 and 46 is limited in this position by means of stops (not shown) so that the lever arm 40 ultimately cannot plunge downwards. Lastly, the stops provide the force necessary for holding the first journal 41. FIGS. 3*b* and 3*c* show additional views that are revealed in the figures.

Figure 4C:
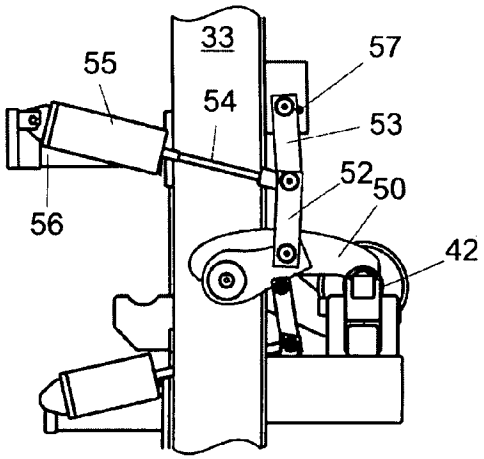
Figure 4B:
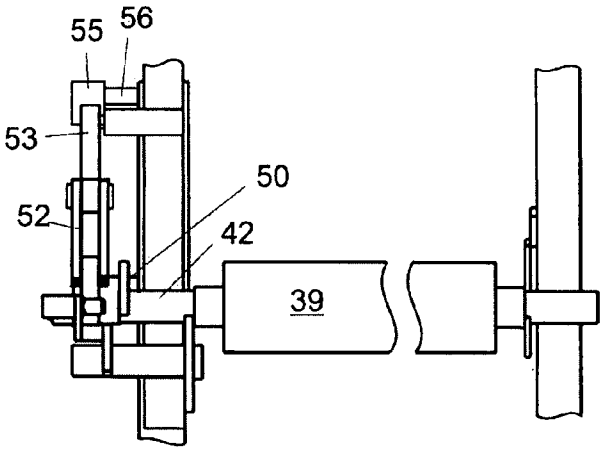
Figure 4A:
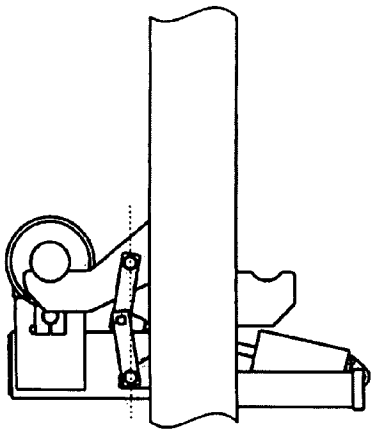

FIGS. 4*a*, 4*b*, 4*c* show the situation, in which the second journal 42 is held by a second lever arm 50. Since the second journal bears on the support 43, as described above, the lever arm 50 is placed on the journal 42 from the top. Since the support 43 is disposed close to the cylinder body and the lever arm 50 is disposed so as to be distant from the roller body, the roller can now be held by means of the second journal 42 alone. For lowering the second lever arm 50, a pair of levers 52 and 53 connected by means of a flexible joint 51 is provided, as in the case of the lever arm 40. The piston 54 of a pressurizing-medium cylinder 55 that is preferably actuated by means of compressed air acts in the region of the flexible joint. The pressurizing-medium cylinder 55 is articulated to a feeder system 56 that is in turn attached to the stand 33. When extending the piston, the levers are thus rotated such that they are transferred by degrees into an extended position. In doing so, the second lever arm 50 is lowered increasingly. In the position of the maximum extension of the levers 52 and 53, the three fulcrums are located in a line. But the movement does not end here; but instead, the piston is moved somewhat further. A further movement of the levers is limited by a suitable stop shown in the form of a pin 57 in FIG. 4*c*. The pin prevents the second lever arm 50 from being lifted again by the action of the second journal 42. The pin 57 thus provides a considerable part of the force required for holding the roller at one end thereof. This measure is particularly advantageous when there is no pressurizing medium present that can provide pressure in the pressurizing-medium cylinder 56, for example, if compressed air is not used. A backward movement of the levers 52, 53 is carried out only when the piston 54 of the pressurizing-medium cylinder is actively retracted again.

Figure 5C:
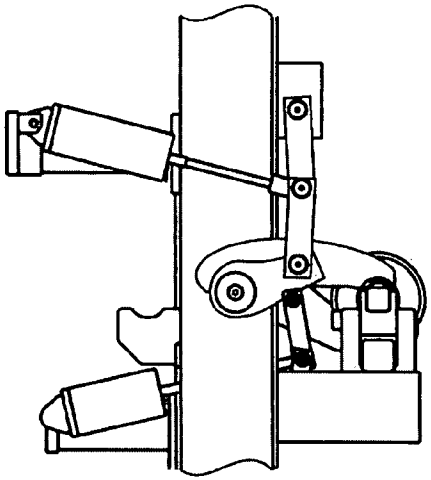
Figure 5B:
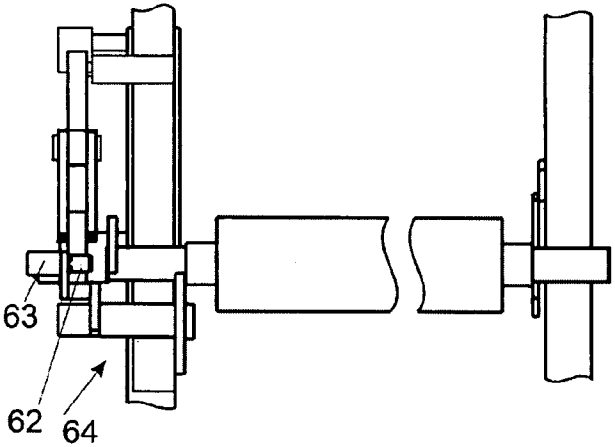
Figure 5A:
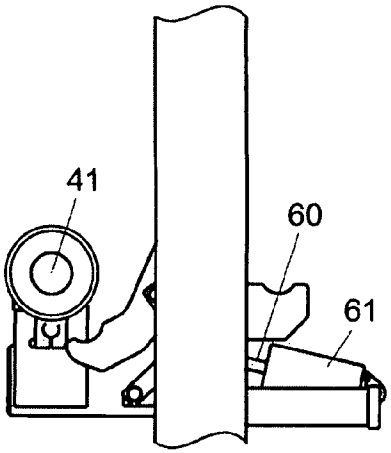

FIGS. 5*a*, 5*b*, 5*c* show a situation, in which the first journal 41 is exposed by pivoting the lever arm 40. The first lever arm 40 is pivoted by retracting the piston 60 of the pressurizing-medium cylinder 61. As a result, the flexible joint 48 is moved so that the levers 45, 46 travel beyond the point of their maximum extension and they are folded up like scissors. In doing so, the lever arm 40 is pivoted to such an extent that it no longer extends into the cross-section of the roller 8, 9 (see FIG. 5*a*).

It is now possible to pull off a sleeve of the print roller or anilox roller 8, 9 from the same. In order to simplify this process, the roller 8, 9 has a pressurizing-medium guiding system, for example, compressed-air lines that guide the pressurizing medium from filler openings by means of said lines to pressurizing-medium discharge openings that are covered by a sleeve, when the latter has been slid on the roller. When the pressurizing medium is applied to the roller, the pressurizing medium forms a film between the outer surface of the roller and the inner surface of the sleeve, and the sleeve can now slide on this film of pressurizing medium so that the sleeve can be pulled off without much effort.

Figure 6C:
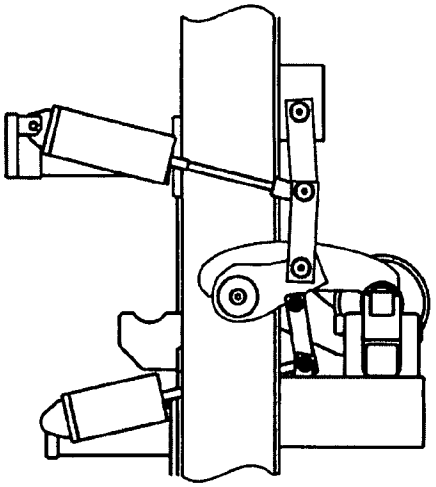
Figure 6B:
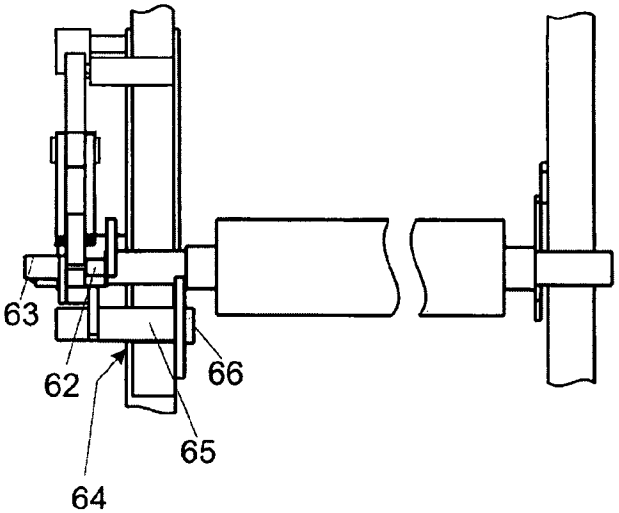
Figure 6A:
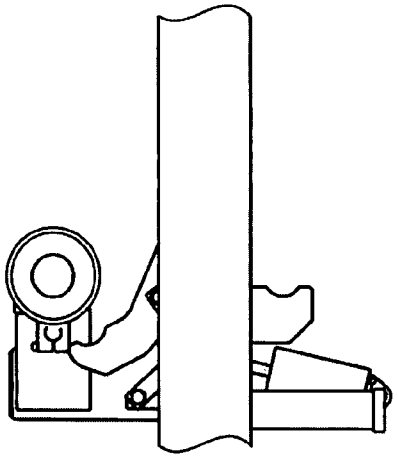

In order to be able to supply the pressurizing medium to the roller, the latter comprises a filler opening disposed preferably on the front side on any of the two journals, here journal 42. Matching the filler opening, a coupling piece 62 is disposed which is connected to pressurizing-medium supply lines (not shown in FIG. 5*b*). This coupling piece 62 is displaceable by means a compressed-air piston 63. For this purpose, the compressed-air piston 63 is suitably mounted on the stand 33, for example, with the help of a carrier. FIG. 6*b* shows a situation, in which the coupling piece is brought closer to the filler opening. The sleeve can now be pulled off.

Figure 7C:
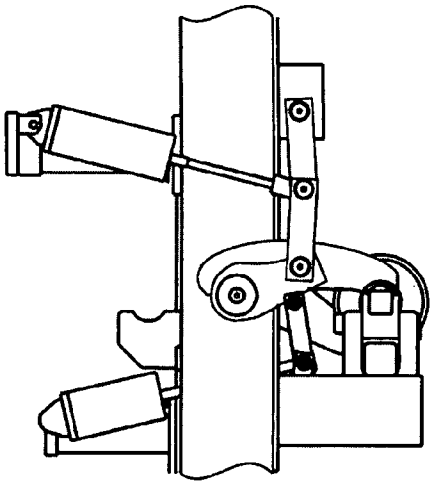
Figure 7B:
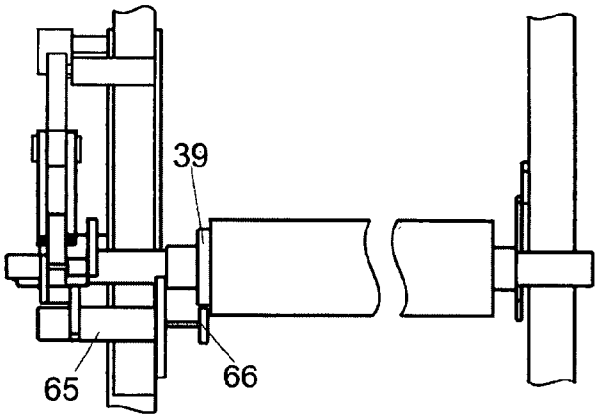
Figure 7A:
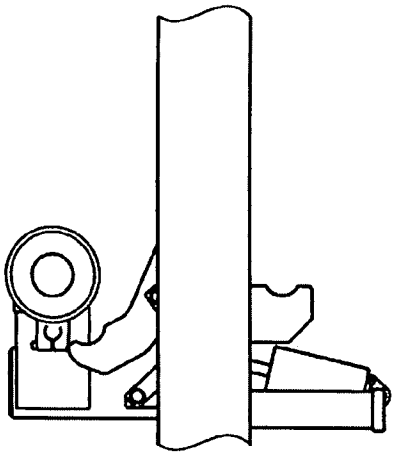

Since leakages in the ink circuit of the printing press can also result in the undesirable discharge or transfer of ink in the case of anilox rollers, the sleeves are often stuck to the rollers due to the ink becoming touch dry or drying up. This makes it greatly difficult to change the sleeve. The sleeves often cannot be changed since the machine operator can only grasp the sleeve at the outer surface thereof, but often cannot transmit the force required to pull off the sleeve. For this reason, a sleeve-displacing device 64 is provided according to a further advantageous embodiment of the invention. This sleeve-displacing device 64 comprises, as its essential components, an additional pressurizing-medium piston cylinder 65 and a slide 66. The pressurizing-medium piston cylinder 65 is disposed on the stand 33 by means of the carrier support 44. FIG. 7*b* shows a situation, in which the slide has been extended by means of the pressurizing-medium piston cylinder 65 and the sleeve has been displaced to a certain extent in the axial direction. A slight axial displacement of the sleeve relative to the roller is sufficient to loosen sleeves that are stuck to the rollers due to dried or encrusted ink. The sleeve can usually be pulled off from the roller easily by hand.

Once the old sleeve has been pulled off, a new sleeve carrying a print motif for any of the subsequent print jobs can be slid onto the roller.

After the roller has been set up for the follow-up job, the first lever arm can again be placed against the first journal and the second lever arm can be removed from the second journal. This roller can now be transferred by the crane into the inking system or into any other roller-bearing position.

As already described above, it is advantageous if sleeves can be replaced at a total of four positions. After each roller has been equipped with a sleeve for a job, for example, the subsequent job, this roller can be transported by the crane to a free roller position 31 that is arbitrary. Another roller that has yet to be equipped with a sleeve can now be lifted and placed in the change position 32.

After almost all or at least one or a few rollers have been prepared for the follow-up job in the manner described, the printing machine 1 can be set up. First, the anilox roller 9 is lifted out of an inking system by means of any one of the cranes 20 present and deposited in any free roller position 31 or a free change position 32. The print roller is then lifted out of the inking system in question. Advantageously, these rollers are lifted out of the inking system even as the printing press is still processing the current job if said inking system is not required for the current job. This results in further accelerating the process of preparing the printing press for the follow-up job. The new rollers can now be inserted into the inking system to be equipped, for which purpose the print roller 8 and then the anilox roller 9 are inserted into the inking system. After one inking system has been equipped, the other inking systems follow. Each of the cranes shown in the exemplary embodiment described is required to carry out the process of equipping four inking systems.

However, an anilox roller can also remain in the inking system in, question if the associated print roller 8 is being changed. This is advantageous when the printing ink in this inking system does not have to be replaced.

FIGS. 3*a*-7*a*, 3*b*-7*b*, and 3*c*-7*c* show the same components. Even though not all figures show the components described together with their reference numerals, the reference numerals that could denote these components are unambiguous.

The processes of changing rollers are controlled by a control device that receives instructions from the machine operator by means of operator controls (not shown in the figures). By means of the operator controls, the operator can enter or select the current position of a roller and can specify the position, into which the roller is to be transferred. A change command to be entered by the machine operator activates the transfer process. It is also feasible for the control device to merely indicate a roller having distinct identification marks such as roller number or print motif on a display device without communicating the specific position to the operator. The operator then selects the roller based on these identification marks and allocates a new position to the same.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

LIST OF REFERENCE NUMERALS

1 Printing press
2 Impression cylinder
3 Printing substrate
4 Pressure roller
5 Inking system
6 Bracket
7 Central frame of the printing press
8 Print roller
9 Anilox roller
10 Doctor blade chamber
11 Imaginary center line
12 Housing
20 Crane
21 Gripper
22 Delivery system
23 Carrier beam
24 Vertical support
25 Column
26 Carrier
27 Supporting frame
28 Clearance
29 Roller-transporting carriage
30 Roller bearing
31 Roller position
32 Change position
33 Stand
34 Cantilever arm
35 Recess
36 Carrier
39 Roller body
40 Lever arm
41 First journal
42 Second journal
43 Support
44 Carrier support
45 First lever
46 Second lever
47 Extension
48 Flexible joint
49 Dashed line
50 Second lever arm
51 Flexible joint
52 Lever
53 Lever
54 Piston
55 Pressurizing-medium cylinder
56 Feeder system
57 Pin
60 Piston
61 Pressurizing-medium cylinder
62 Coupling piece
63 Compressed-air piston
64 Sleeve-displacing device
65 Pressurizing-medium piston cylinder
66 Slide
R Direction of rotation of the central impression cylinder

What is claimed is:

1. A printing press comprising:

a plurality of inking systems, which cooperate with at least one impression cylinder, each of the inking systems including a print roller and at least one additional ink-transfer roller, each of which includes a roller body, at front sides of which a first and a second end shaft journal is disposed;

at least one roller-bearing device, in which the print rollers and the ink-transfer rollers are mountable outside the inking systems in roller-bearing positions, including at least one roller-bearing position in which one of the rollers can be set up for a subsequent print job; and a transfer element, via which at least the print rollers or the ink-transfer rollers are transportable substantially in radial directions thereof between the roller-bearing positions and the inking systems, with the roller-bearing device including a holding element in the at least one roller-bearing position for at least temporarily holding the roller by either the first or the second end shaft journal thereof alone, the holding element including a lever arm, which is pivotably mounted on the roller-bearing device, and a first lever and a second lever, with first ends of the first lever and the second lever being connected to each other by a swivel joint, the first level being rotatably connected to the lever arm, and the second lever being rotatably connected to the roller-bearing device.

2. The printing press as defined in claim 1, wherein the roller-bearing device includes the holding element at four of the roller-bearing positions.

3. The printing press as defined in claim 1, wherein the roller-bearing position includes at least a first support element and at least a second support element, on each of which a corresponding one of the first and second end shaft journals can be placed.

4. The printing press as defined in claim 3, wherein the first support element is removable from the first end shaft journal when the roller is held by the second end shaft journal.

5. The printing press as defined in claim 3, further comprising a force-transmitting element, which is located at a distance from the second support element in an axial direction of the journal, that acts on the journal which bears on the second support element.

6. The printing press as defined in claim 3, further comprising a second lever arm, to which a holding force can be applied, that is placeable on the journal that bears on the second support element.

7. The printing press as defined in claim 1, wherein the lever arm is pivotable via a pressurizing-medium cylinder.

8. The printing press as defined in claim 1, further comprising on the roller-bearing device a sleeve-displacing device including at least one slide, which operatively interacts with a sleeve that has been slid on a roller and which is movable relative to the roller-bearing device.

9. The printing press as defined in claim 1, further comprising on the roller-bearing device a compressed-air supply device including at least one pressurizing-medium nozzle, which can be pressed against a pressurizing-medium supply opening of the roller via a displacing device.

10. The printing press as defined in claim 1, wherein the roller-bearing device has a larger number of roller-bearing positions than the number resulting from a sum of the maximum number of rollers in the printing press and the number of rollers that can be inserted into two of the inking systems.

11. The printing press as defined in claim 1, wherein a plurality of sets of print rollers are mountable in the roller-bearing device.

12. The printing press as defined in claim 1, further comprising a control device, to which a position of a print roller in the roller-bearing device and an intended position thereof in the inking system can be communicated by operator controls, and which controls the transfer element such that the roller can be transferred from one position into another position.

13. A method of operating a printing press that includes a plurality of inking systems, which cooperate with at least one impression cylinder, each of the inking systems including a print roller and at least one additional ink-transfer roller, each of which includes a roller body, at front sides of which a first and a second end shaft journal is disposed, at least one roller-bearing device, in which the print rollers and the ink-transfer rollers are mountable outside the inking systems in roller-bearing positions, including at least one roller-bearing position in which one of the rollers can be set up for a subsequent print job, and a transfer element, via which at least the print rollers or the ink-transfer rollers are transportable substantially in radial directions thereof between the roller-bearing positions and the inking systems, with the roller-bearing device including a holding element in the at least one roller-bearing position for at least temporarily holding the roller by either the first or the second end shaft journal thereof alone, the holding element including a lever arm, which is pivotably mounted on the roller-bearing device, and a first lever and a second lever, with first ends of the first lever and the second lever being connected to each other by a swivel joint, the first lever being rotatably connected to the lever arm, and the second lever being rotatably connected to the roller-bearing device, said method comprising:

transporting the print rollers or the ink-transfer rollers, substantially in the radial directions thereof, between the roller-bearing positions and the inking systems, including at least temporarily holding the roller in the roller-bearing device by the first or the second end shaft journal thereof with the holding element.

14. The method according to claim 13, wherein a plurality of sets of print rollers are mounted in the roller-bearing device.

* * * * *